US009617623B2

(12) United States Patent
Sung et al.

(10) Patent No.: US 9,617,623 B2
(45) Date of Patent: Apr. 11, 2017

(54) ALUMINUM ALLOY INCLUDING IRON-MANGANESE COMPLETE SOLID SOLUTION AND METHOD OF MANUFACTURING THE SAME

(75) Inventors: Si Young Sung, Chungcheongnam-do (KR); Beom Suck Han, Gyeonggi-do (KR)

(73) Assignee: KOREA AUTOMOTIVE TECHNOLOGY INSTITUTE, Cheonan-si, Chungcheongnam-do (KR)

( * ) Notice: Subject to any disclaimer, the term of this patent is extended or adjusted under 35 U.S.C. 154(b) by 410 days.

(21) Appl. No.: 14/235,616

(22) PCT Filed: Jul. 26, 2012

(86) PCT No.: PCT/KR2012/005987

§ 371 (c)(1),
(2), (4) Date: Jan. 28, 2014

(87) PCT Pub. No.: WO2013/015641

PCT Pub. Date: Jan. 31, 2013

(65) Prior Publication Data

US 2014/0170018 A1 Jun. 19, 2014

(30) Foreign Application Priority Data

Jul. 28, 2011 (KR) ..... 10-2011-0075418

(51) Int. Cl.
*C22F 1/04* (2006.01)
*B22D 21/04* (2006.01)
(Continued)

(52) U.S. Cl.
CPC ..... *C22C 21/00* (2013.01); *B22D 17/00* (2013.01); *B22D 21/007* (2013.01); *C22C 1/026* (2013.01); *C22C 21/02* (2013.01); *C22C 21/08* (2013.01)

(58) Field of Classification Search
CPC ..... C22C 21/00; C22C 21/02; C22C 21/08; C22C 1/026; B22D 17/00; B22D 21/007
See application file for complete search history.

(56) References Cited

U.S. PATENT DOCUMENTS 4,832,911 A * 5/1989 Dube ..... C22C 1/026 420/528
2003/0033904 A1* 2/2003 Ilia ..... C22C 33/0207 75/252

(Continued)

FOREIGN PATENT DOCUMENTS

CN 1654694 A 8/2005
GB 2112020 A 7/1983

(Continued)

OTHER PUBLICATIONS

Japanese Office Action dated May 17, 2016; Appln. No. 2014-522755.
Sung-Hwan Choi, et al; "High Temperature Tensile Deformation Behavior of New Heat Resistant Aluminum Alloy", Procedia Engineering, vol. 10, Jun. 10, 2011; pp. 159-164; XP028253116.
Lorella Ceschini, et al; "Microstructure, tensile and fatigue properties of the A1—10%Si—2%Cu alloy with different Fe and Mn content cast under controlled conditions", Journal of Materials Processing Technology, vol. 209, No. 15-16, Aug. 1, 2009, pp. 5669-5679, XP026348370.

(Continued)

*Primary Examiner* — Lois Zheng
(74) *Attorney, Agent, or Firm* — Ladas & Parry LLP

(57) ABSTRACT

Provided are an aluminum alloy including an iron-manganese complete solid solution and a method of manufacturing the same. According to an embodiment of the present invention, iron-manganese alloy powder is provided. The iron-manganese alloy powder is introduced into an aluminum melt. An aluminum alloy including an iron-manganese complete solid solution is manufactured by die casting the aluminum melt.

9 Claims, 10 Drawing Sheets

(51) Int. Cl.

| | |
|---|---|
| ***C22C 21/00*** | (2006.01) |
| ***B22D 17/00*** | (2006.01) |
| ***C22C 21/02*** | (2006.01) |
| ***C22C 21/08*** | (2006.01) |
| ***C22C 1/02*** | (2006.01) |
| ***B22D 21/00*** | (2006.01) |

(56) References Cited

U.S. PATENT DOCUMENTS

| | | | | |
|---|---|---|---|---|
| 2005/0173032 | A1 | 8/2005 | Koch et al. | |
| 2012/0020829 | A1* | 1/2012 | Sung | C22F 1/057 420/538 |

FOREIGN PATENT DOCUMENTS

| | | | |
|---|---|---|---|
| JP | 05-115954 | A | 5/1993 |
| JP | 10-102105 | A | 4/1998 |
| JP | 2005-264301 | A | 9/2005 |
| JP | 2006-274351 | A | 10/2006 |
| JP | 2011-104655 | A | 6/2011 |
| KR | 20100087585 | A | 8/2010 |
| KR | 20100087588 | A | 8/2010 |
| WO | 2010/087605 | A2 | 8/2010 |

OTHER PUBLICATIONS

A.M.A. Mohamed, et al; "Influence of additives on the microstructure and tensile properties of near-eutectic A1—10.8%Si cast alloy", Materials and Design, London, GB, vol. 30, No. 10, Available online Jun. 6, 2009, pp. 3943-3957, XP026250603.

C.M. Dinnis, et al; "Interactions between Iron, Manganese, and the Al—Si Eutectic in Hypoeutectic Al—Si Alloys", Metallurgical and Materials Transactions A, vol. 37, No. 11, Nov. 1, 2006, pp. 3283-3291, XP019696204.

S.G. Shabestari, et al; "Effect of plastic deformation and semisolid forming on iron-manganese rich intermetallics in A1—8Si—3Cu—4Fe—2Mn alloy", Journal of Alloys and Compounds, vol. 508, No. 2, Oct. 22, 2010, pp. 314-319, XP027409540.

K. Sasamori, et al; "Mechanical properties and microstructures of melt-wuenched A1—Fe—Ti—M (M=V, Cr, Mn) alloys", XP002732376, Database Compendex [Online] Engineering Information, Inc., New York, NY, US; Apr. 2000.

Huang Haijun, et al; "Solidification Structure of Cast A1—25Si—xFe—yMn Alloy", XP002732377; The Institution of Electrical Engineers, Stevenage, GB; 2010.

Extended European Search Report dated Nov. 25, 2014; 12817840.7-1362/2738272 PCT/KR2012005987.

* cited by examiner

ALUMINUM ALLOY INCLUDING IRON-MANGANESE COMPLETE SOLID SOLUTION AND METHOD OF MANUFACTURING THE SAME

TECHNICAL FIELD

The present invention relates to an aluminum alloy and a method of manufacturing the same, and more particularly, to an aluminum alloy, in which an iron-manganese complete solid solution is formed in an aluminum matrix, and a method of manufacturing the same.

BACKGROUND ART

Alloying elements are added to aluminum alloys for a variety of purposes. These alloying elements may affect casting quality or an alloy structure. Therefore, there is a need to control types and forms of the alloying elements for the purpose of improving the casting quality or controlling the alloy structure.

For example, in view of the casting quality, iron may be added for preventing soldering of an aluminum alloy and a die manufactured with an iron-based alloy. However, since iron may decrease corrosion resistance of the aluminum alloy, the addition of iron may also be limited. In this regard, there is a need to prevent the decrease of the corrosion resistance as well as the die soldering by adding iron to the aluminum alloy.

As another example, in view of the alloy structure, heat resistance properties of a typical heat-resistant aluminum alloy may be realized by adding iron or the like to an aluminum matrix to disperse and control intermetallic compounds between aluminum and the alloying elements. These intermetallic compounds may be crystallized in the aluminum matrix during solidification from a liquid phase to a solid phase or may be precipitated in the aluminum matrix by a heat treatment of the aluminum alloy.

However, the heat resistance properties of the above aluminum alloy may deteriorate in an environment of 200° C. or more. In a case where the aluminum alloy is held at 200° C. or more for a long period of time, the crystallized or precipitated intermetallic compounds may react with the aluminum matrix to form new intermediate phases in order for the crystallized or precipitated intermetallic compounds to maintain thermodynamic equilibrium or the generation and propagation of cracks may occur due to the coarsening of such intermetallic compounds.

DISCLOSURE OF THE INVENTION

Technical Problem

The present invention provides an aluminum alloy including an iron-manganese completed solid solution in an aluminum matrix and a method of manufacturing the same.

Objects of the present invention are exemplarily provided, and the scope of the present invention is not limited by these objects.

Technical Solution

According to an aspect of the present invention, there is provided a method of manufacturing an aluminum alloy. Iron-manganese alloy powder is provided. The iron-manganese alloy powder is introduced into an aluminum melt. An aluminum alloy including an iron-manganese complete solid solution is manufactured by die casting the aluminum melt.

In the manufacturing method, the iron-manganese alloy powder may be prepared using an atomization method.

The manufacturing method may further include melting at least a portion of the iron-manganese alloy powder in the aluminum melt, after the introducing of the iron-manganese alloy powder. Furthermore, the melting may be performed using a plasma arc melting method or a vacuum induction melting method.

In the manufacturing method, the aluminum melt may include copper and silicon as additive elements in addition to aluminum as a parent material.

In the manufacturing method, the aluminum melt may include silicon and magnesium as additive elements in addition to aluminum as a parent material.

According to another aspect of the present invention, there is provided an aluminum alloy including an aluminum matrix; and an iron-manganese complete solid solution distributed in the aluminum matrix, wherein the aluminum alloy has a higher elongation than other aluminum alloys having a same composition in which iron and manganese do not form a complete solid solution but form compounds with aluminum.

According to another aspect of the present invention, there is provided a method of manufacturing an aluminum alloy. A first aluminum alloy including a first amount of an iron-manganese complete solid solution is provided. The first aluminum alloy is melted in an aluminum melt. A second aluminum alloy including a second amount, which is smaller than the first amount, of the iron-manganese complete solid solution is manufactured by casting the aluminum melt.

In the manufacturing method, the providing of the first aluminum alloy may include melting iron and manganese by introducing into a first aluminum melt; and casting the first aluminum melt.

In the manufacturing method, the providing of the first aluminum alloy may include forming a powder mixture by mixing iron powder and manganese powder; melting the powder mixture by introducing into a first aluminum melt; and casting the first aluminum melt.

In the manufacturing method, the providing of the first aluminum alloy may include providing an aluminum-iron master alloy and an aluminum-manganese master alloy; melting the aluminum-iron master alloy and the aluminum-manganese master alloy by introducing into a first aluminum melt; and casting the first aluminum melt.

In the manufacturing method, the providing of the first aluminum alloy may include providing an iron-manganese alloy; melting the iron-manganese alloy by introducing into a first aluminum melt; and casting the first aluminum melt.

According to another aspect of the present invention, there is provided a method of manufacturing an aluminum alloy. A powder mixture is formed by mixing iron powder and manganese powder. The powder mixture is melted by introducing into an aluminum melt. An aluminum alloy, in which an iron-manganese complete solid solution is distributed in an aluminum matrix, is manufactured by casting the aluminum melt.

In the manufacturing method, the forming of the powder mixture may include mixing the iron powder and the manganese powder by introducing into a milling device; and screening the mixed powder.

Advantageous Effects

Since an aluminum alloy according to an embodiment of the present invention includes an iron-manganese completed solid solution which does not react with an aluminum matrix even at a high temperature, the aluminum alloy may have excellent heat resistance properties even at a high temperature. Therefore, the aluminum alloy may maximize a weight reduction effect by being used in a piston of a diesel engine and aircraft parts, in which a typical heat-resistant aluminum alloy has not been used due to its limitation, and may improve fuel economy by increasing a heat resistance limit of automotive engines that are currently used.

According to a method of manufacturing an aluminum alloy according to an embodiment of the present invention, since an aluminum alloy is manufactured using iron-manganese alloy powder, an iron-manganese complete solid solution may be effectively dispersed in an aluminum matrix. As a result, since iron may form a complete solid solution with manganese, an adverse effect due to the addition of iron during casting may be prevented.

According to the method of manufacturing an aluminum alloy according to the embodiment of the present invention, since a master alloy including an iron-manganese complete solid solution may be manufactured and may then be used in industrial sites by diluting the master alloy, mass production of the aluminum alloy may be facilitated.

MODE FOR CARRYING OUT THE INVENTION

Hereinafter, the present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art.

In embodiments of the present invention, an aluminum alloy may denote an alloy in which one or more alloying elements are added to aluminum, i.e., a main element. Also, an aluminum melt is used as a broad meaning including a melt formed of pure aluminum or a melt of an aluminum alloy in which one or more alloying elements are added to pure aluminum.

In the embodiments of the present invention, a complete solid solution may denote an alloy in which any one alloying element is substantially dissolved in another alloying element in an entire compositional range.

Figure 1:
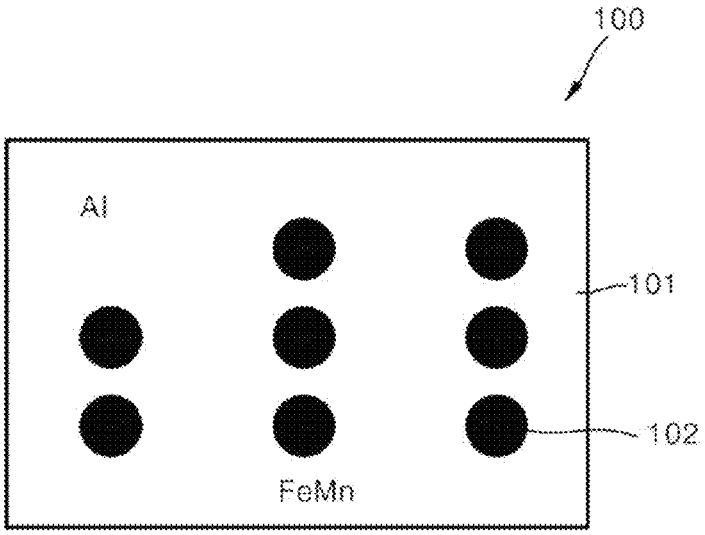
FIG. 1 is a conceptual view illustrating a stable high-temperature behavior of an aluminum alloy according to embodiments of the present invention.

FIG. 1 is a conceptual view illustrating a high-temperature behavior of an aluminum alloy according to embodiments of the present invention.

Referring to FIG. 1, an aluminum alloy 100 may include a complete solid solution 102 which is distributed in an aluminum matrix 101 while forming a separate phase. Alloying elements forming the complete solid solution 102 do not substantially have solubility in aluminum. Iron and manganese may be selected as such alloying elements. That is, iron and manganese do not substantially have solubility in aluminum. Also, iron and manganese may form a complete solid solution to each other.

Figure 2:
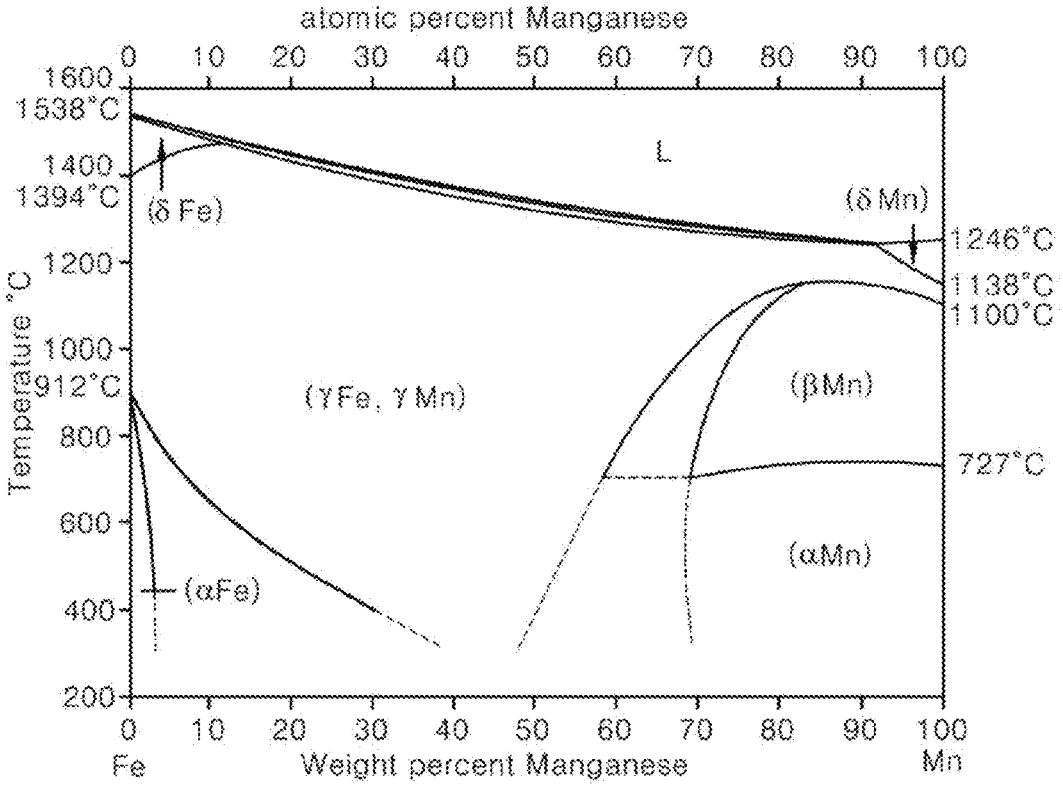
FIG. 2 illustrates an iron-manganese binary phase diagram.

As illustrated in FIG. 2, it may be confirmed that iron and manganese form a complete solid solution to each other and the complete solid solution is stable as a solid phase even at 1800° C. which is a significantly higher temperature than 660° C., i.e., a melting point of aluminum.

That is, in a case where the iron-manganese complete solid solution 102 is distributed in the aluminum matrix 101, since the iron-manganese complete solid solution 102 may maintain a stable single phase even above the melting point of aluminum, the iron-manganese complete solid solution 102 is not decomposed but maintains a stable single phase even in an environment having a high temperature near the melting point of aluminum.

In the aluminum alloy 100, since the iron-manganese complete solid solution 102 may be distributed in the aluminum matrix 101 and may exist as a stable strengthening phase that does not react with the aluminum matrix 101 at all even at a high temperature of 200° C. or more, the iron-manganese complete solid solution 102 is not decomposed or coarsened. Also, since the complete solid solution 102 stably exists even if it is heated to the melting point of aluminum, the previously formed complete solid solution strengthening phase may stably exist even in the case in which the aluminum alloy 100 is remelted and then again solidified.

In the aluminum alloy 100, an amount of the iron-manganese complete solid solution 102 may be in various ranges, and for example, may be in a range of 0.5 wt % to 40 wt %. Furthermore, the amount of the complete solid solution 102 may be greater than 0.5 wt % and less than 10 wt % in consideration of the average size thereof as described later. Also, the amount of the complete solid solution 102 may be limited within 2 wt %, in particular, 1 wt % in consideration of the fluidity of the melt during casting of the aluminum alloy 100.

In the iron-manganese complete solid solution 102, since iron and manganese are elements that form a complete solid solution, the compositional ratio thereof is not particularly limited. For example, an amount of iron may be in a range of 10 wt % to 90 wt %, and manganese may be included as a remainder.

According to a method of manufacturing an aluminum alloy according to an embodiment of the present invention, the alloy may be manufactured by respectively adding iron and manganese as alloying elements to an aluminum melt in which aluminum is melted. In this case, the added iron and manganese are combined each other while being melted in the aluminum melt to form a complete solid solution.

When the added iron and manganese are completely melted in the aluminum melt, an iron-manganese complete solid solution strengthening aluminum alloy may be manufactured by casting the melt in a mold. In this case, the added iron and manganese may have the form of pellets, particles, or powder.

In a case where the iron and manganese have the form of powder, each powder is mixed to prepare a powder mixture, and the powder mixture may then be introduced into the aluminum melt. Amounts of the iron powder and the manganese powder in the powder mixture may be variously selected in consideration of the formation of the complete solid solution. For example, a weight ratio of the iron powder to the manganese powder may be in a range of 1:9 to 9:1.

For example, the iron and manganese powder are introduced into a milling device and then mixed for 10 minutes to 1 hour. Next, the powder mixture, in which the iron and manganese powder are mixed to each other, is taken out from the milling device, and then screened to sampling the powder mixture that is included within a predetermined particle size range. Thereafter, the screened powder mixture is added to the aluminum melt as an additive. In this case, the powder mixture may be used by being packed into an appropriate size.

As another embodiment, instead of respectively adding iron and manganese to the aluminum melt, an iron-manganese alloy manufactured by melting iron and manganese in advance is prepared, and an aluminum alloy may then be manufactured by introducing the above iron-manganese master alloy into the aluminum melt and casting. In this case, at least a portion of the iron-manganese alloy may be melted in the melt before the casting of the melt. As described later, in a case where an appropriate melting method is used, substantially all of the iron-manganese alloy may be melted in the melt.

The iron-manganese alloy may be manufactured in various forms, and for example, may be manufactured in the form of an iron-manganese alloy powder by an atomization method. For example, iron and manganese are melted to form an iron-manganese melt, and cold gas or water may then be sprayed into the melt to form iron-manganese alloy powder that has a fine size and forms a completed solid solution. As a result, when the iron-manganese alloy powder is provided in advance, the alloy powder is introduced into the aluminum melt and the aluminum melt is then cast without melting the alloy powder so that an aluminum alloy, in which an iron-manganese complete solid solution is distributed in an aluminum matrix, may be economically manufactured.

However, in a modified example of the above embodiment, melting at least a portion of the iron-manganese alloy powder in the aluminum melt before the casting of the aluminum melt may be added in order to control the size of iron-manganese complete solid solution particles.

In the above alloy, various elements may be included in the aluminum melt as additive elements in addition to aluminum as a parent material. That aluminum is a parent material means that aluminum is included in an amount of 50% or more in the alloy. For example, one or more additive elements, such as copper, silicon, magnesium, zinc, nickel, and tin, may be included in the aluminum melt.

The aluminum alloy according to an embodiment of the present invention may include 1 wt % to 4 wt % of copper, 9 wt % to 13 wt % of silicon, and other elements in order to secure high strength characteristics. The aluminum alloy according to another embodiment of the present invention may include 1 wt % to 3 wt % of silicon, 4 wt % to 7 wt % of magnesium, and other elements in order to secure high hardness and elongation properties.

According to another embodiment of the present invention, an aluminum alloy including iron (aluminum-iron alloy) or an aluminum alloy including manganese (aluminum-manganese alloy) may be introduced into the aluminum melt instead of directly introducing iron or manganese.

Various melting methods may be used as a melting method for preparing the above-described aluminum melt, and for example, a plasma arc melting method or an induction melting method may be used. The plasma arc melting method uses a plasma arc as a heat source and melting may be possible over a wide range from a low vacuum to atmospheric pressure. The induction melting method heats and melts a metal conductor by Joule heat which is generated by an eddy-current flowing in the conductor in a direction opposite to that of a current of a coil by the action of electromagnetic induction, wherein the control of composition and temperature may be facilitated due to strong stirring action of the melt.

As a result, in a case where the plasma arc melting method or the induction melting method is used, high-temperature melting is locally possible so that high melting point alloying elements may be melted. Thus, according to the present invention, a complete solid solution between the high melting point alloying elements may be formed in the melt. In a case where the iron-manganese alloy powder is prepared in advance using the atomization method and does not need to be melted in the aluminum melt, economic factors of alloy production may be increased by using a typical electric melting method instead of the plasma arc melting method or the induction melting method.

According to another embodiment of the present invention, the aluminum alloy manufactured by the above-described method is used as a master alloy and the master alloy is diluted by being added to the aluminum melt again. Thus, an aluminum alloy having a decreased amount of the iron-manganese complete solid solution may be manufactured.

In this case, as the aluminum alloy including the iron-manganese complete solid solution, the aluminum alloy, which is added to the aluminum melt (may be referred to as "first aluminum melt") as a master alloy, is defined as a "first aluminum alloy", and the aluminum alloy, which is manufactured by diluting the first aluminum alloy in the aluminum melt and then casting, is defined as a "second aluminum alloy".

Various melting methods may be used to melt the first aluminum alloy, and for example, a plasma arc melting method, induction melting method, or electrical resistance melting method may be used. In particular, in a case of using an electric furnace, the second aluminum alloy may be mass-produced using existing industrial facilities.

Figure 3:
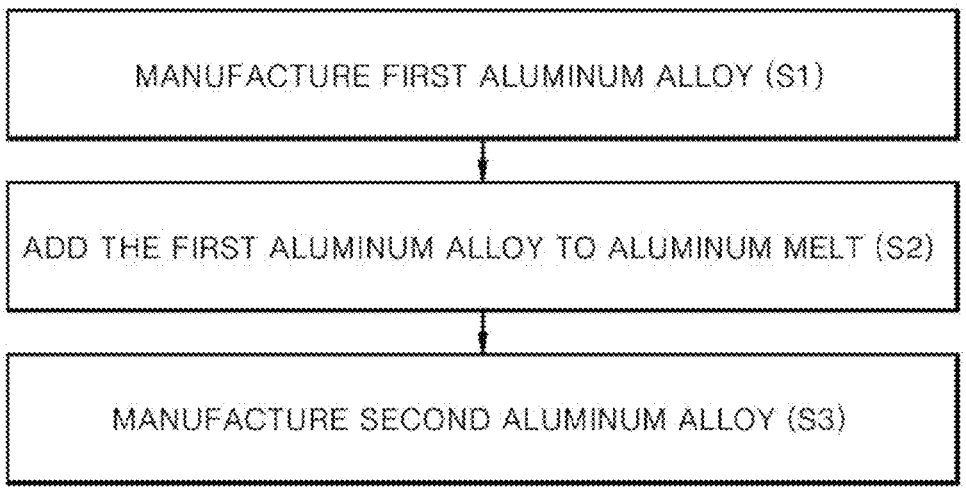
FIG. 3 is a flowchart illustrating a method of manufacturing an aluminum alloy according to an embodiment of the present invention.

Referring to FIG. 3, a first aluminum alloy including a first amount of an iron-manganese completed solid solution is manufactured (S1). In this case, since a method of manufacturing the first aluminum alloy has already been described above in detail, the description thereof is omitted.

Next, the first aluminum alloy thus manufactured is added to an aluminum melt and melted (S2). A temperature of the aluminum melt may be determined in a range of 690° C. to 750° C. which is higher than 660° C., i.e., the melting point of aluminum, in consideration of heat loss similar to the case of manufacturing the first aluminum alloy.

Thereafter, a second aluminum alloy including a second amount of the iron-manganese completed solid solution is manufactured in an aluminum matrix by casting the aluminum melt after the first aluminum alloy is melted. Since the second aluminum alloy is diluted from the first aluminum alloy, the amount (second amount) of the complete solid solution in the second aluminum alloy may be lower than the amount (first amount) of the complete solid solution in the first aluminum alloy. That is, the amount of the iron-manganese complete solid solution in the second aluminum alloy may be decreased corresponding to a dilution ratio in comparison to the first aluminum alloy according to the dilution of the first aluminum alloy.

For example, the amount (first amount) of the iron-manganese complete solid solution in the first aluminum alloy may be selected at a higher concentration than the amount (second amount) of the iron-manganese complete solid solution in the second aluminum alloy. For example, the first amount may be in a range of 1 wt % to 40 wt %, may be greater than 0.5 wt % and less than 10 wt %, and in some case, may be in a range of 10 wt % to 40 wt %. The second amount may be greater than 0.5 wt % and less than 10 wt %, and may be in a range of 0.5 wt % to 2 wt %.

Also, with respect to a microstructure, an average size of the iron-manganese complete solid solution included in the second aluminum alloy may be smaller than an average size of the complete solid solution included in the first aluminum alloy.

In the above-described embodiments, the iron-manganese complete solid solution may also contribute to improve the microstructure and casting quality of the aluminum alloy. During casting of a typical aluminum alloy, iron may deteriorate mechanical properties of the aluminum alloy by forming an intermetallic compound with aluminum or forming an intermetallic compound with aluminum and silicon. Furthermore, it is known that iron may decrease corrosion resistance and ductility of the aluminum alloy. Nevertheless, iron may be added to prevent the soldering with a die that is formed of an iron-based alloy during die casting or to refine grains.

However, according to the embodiments of the present invention, most of iron may exist as an iron-manganese complete solid solution in the aluminum matrix. That is, since manganese may form a complete solid solution with iron, the iron and the manganese may be closely combined with each other to significantly reduce the adverse effect of iron in the aluminum alloy. Therefore, the decrease in the corrosion resistance and/or elongation as well as the die soldering may be prevented by simultaneously adding iron and manganese in the aluminum melt and controlling casting conditions to make the iron and manganese to form the complete solid solution or by adding iron and manganese in the form of an iron-manganese alloy to the aluminum melt.

Thus, according to the embodiments of the present invention, the amount of iron in the aluminum alloy may be increased in comparison to a typical aluminum alloy. For example, the iron-manganese complete solid solution may be formed in an amount of about 2 wt % or less in consideration of the fluidity of the melt. However, in a case where the fluidity of the melt is improved, the amount of the iron-manganese complete solid solution may be further increased.

Hereinafter, experimental examples are provided to allow for a clearer understanding of the present invention. However, the following experimental examples are merely provided to allow for a clearer understanding of the present invention, rather than to limit the scope of the present invention.

EXPERIMENTAL EXAMPLE 1

An aluminum melt was formed by melting aluminum at 700° C., and iron and manganese were then directly and respectively added to the melt in an amount of 1.5 wt % while the temperature was maintained at 700° C. The temperature was held for about 30 minutes to 60 minutes to completely melt the added iron and manganese, and samples of an aluminum alloy were prepared by casting the melt. In this case, the melting was performed by an induction melting method.

Figure 4:
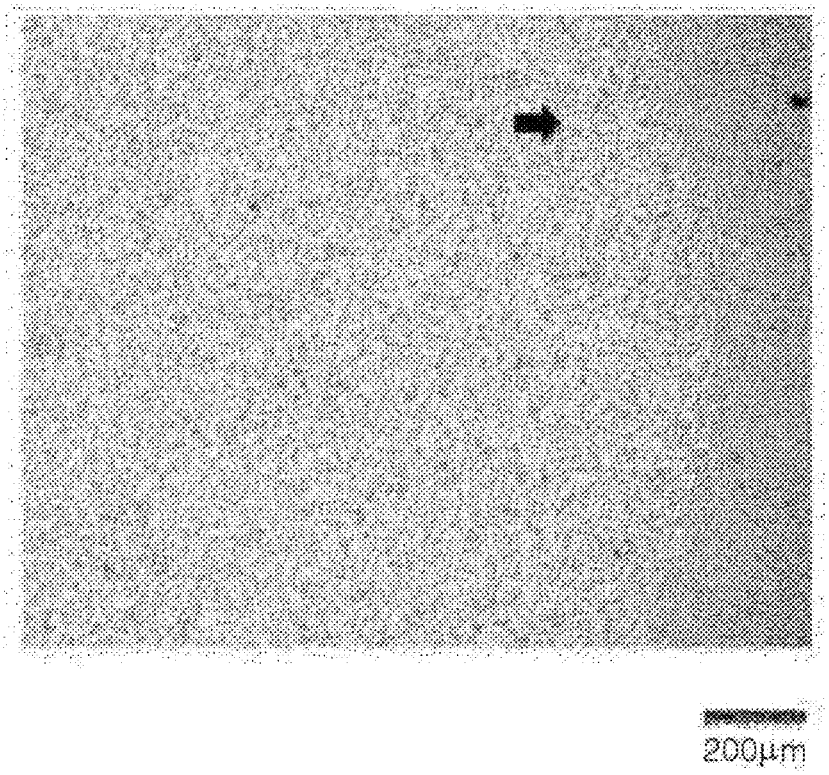
FIG. 4 is a result of optical microscope observation of a microstructure of a sample according to Experimental Example 1.

FIG. 4 is a result of optical microscope observation of a microstructure of the sample according to Experimental Example 1. In this case, the sample was sequentially polished using SiC abrasive papers with grit sizes of 200, 400, 600, 800, 1,000, 1,500, and 2,400, and was finally fine polished using $Al_2O_3$ powder having a size of 1 μm.

Referring to FIG. 4, it may be understood that a strengthening phase (see arrow) in the shape of a facet having a size of 30 μm to 50 μm was included in an aluminum matrix of the aluminum alloy according to Experimental Example 1.

Figure 5:
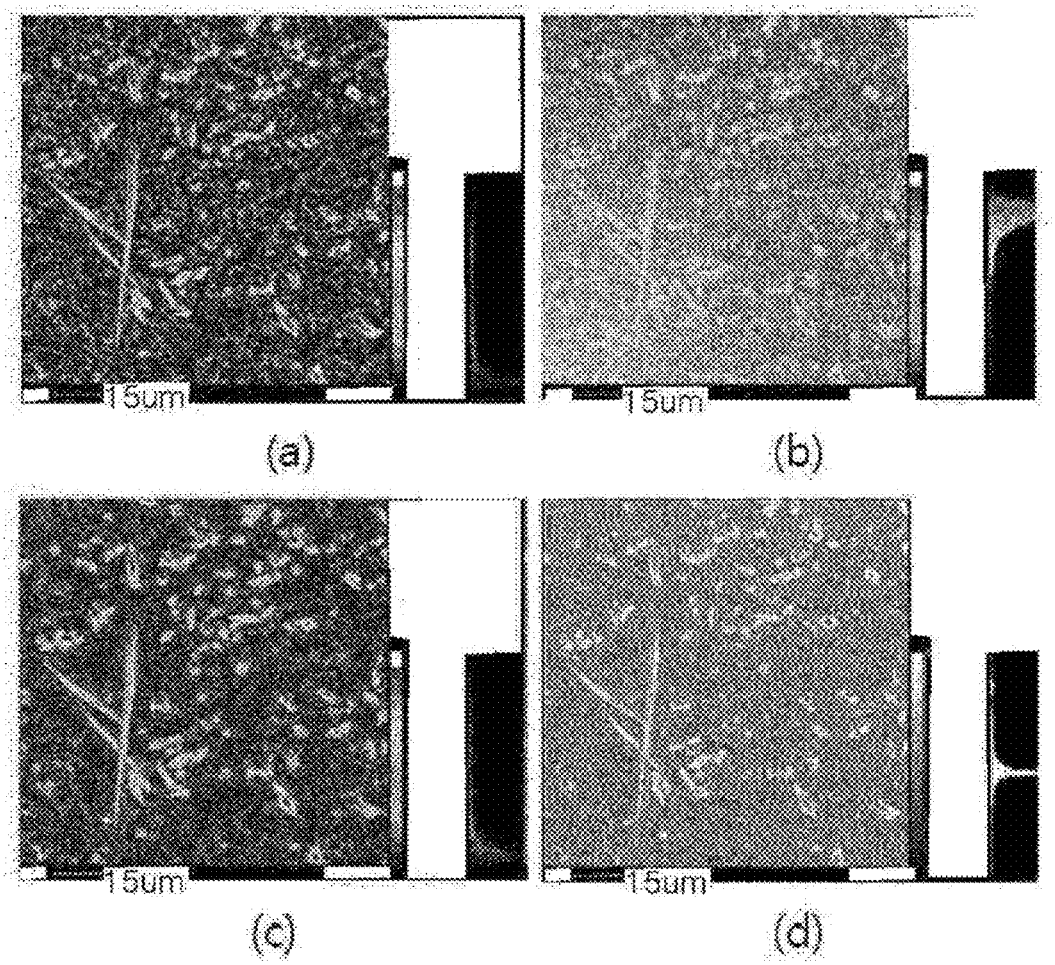
FIG. 5 is images obtained by an electron probe micro-analyzer (EPMA) analysis of the sample according to Experimental Example 1.

FIG. 5 illustrates results of microstructures and compositional analysis obtained from the sample prepared according to Experimental Example 1 using an electron probe micro-analyzer (EPMA). In FIG. 5, (d) is a result of observing the microstructure, and (a), (b), and (c) are results of mapping components of iron, aluminum, and manganese, respectively. It may be understood from FIGS. 5(*a*), 5(*b*), and 5(C) that iron and manganese were simultaneously detected in the strengthening phase in the shape of a facet that was included in the aluminum matrix. As a result, it may be confirmed that the strengthening phase in the shape of a facet was an iron-manganese complete solid solution. In a case where alloying elements were melted using a typical electrical resistance furnace, the above-described complete solid solution was not formed.

Figure 10:
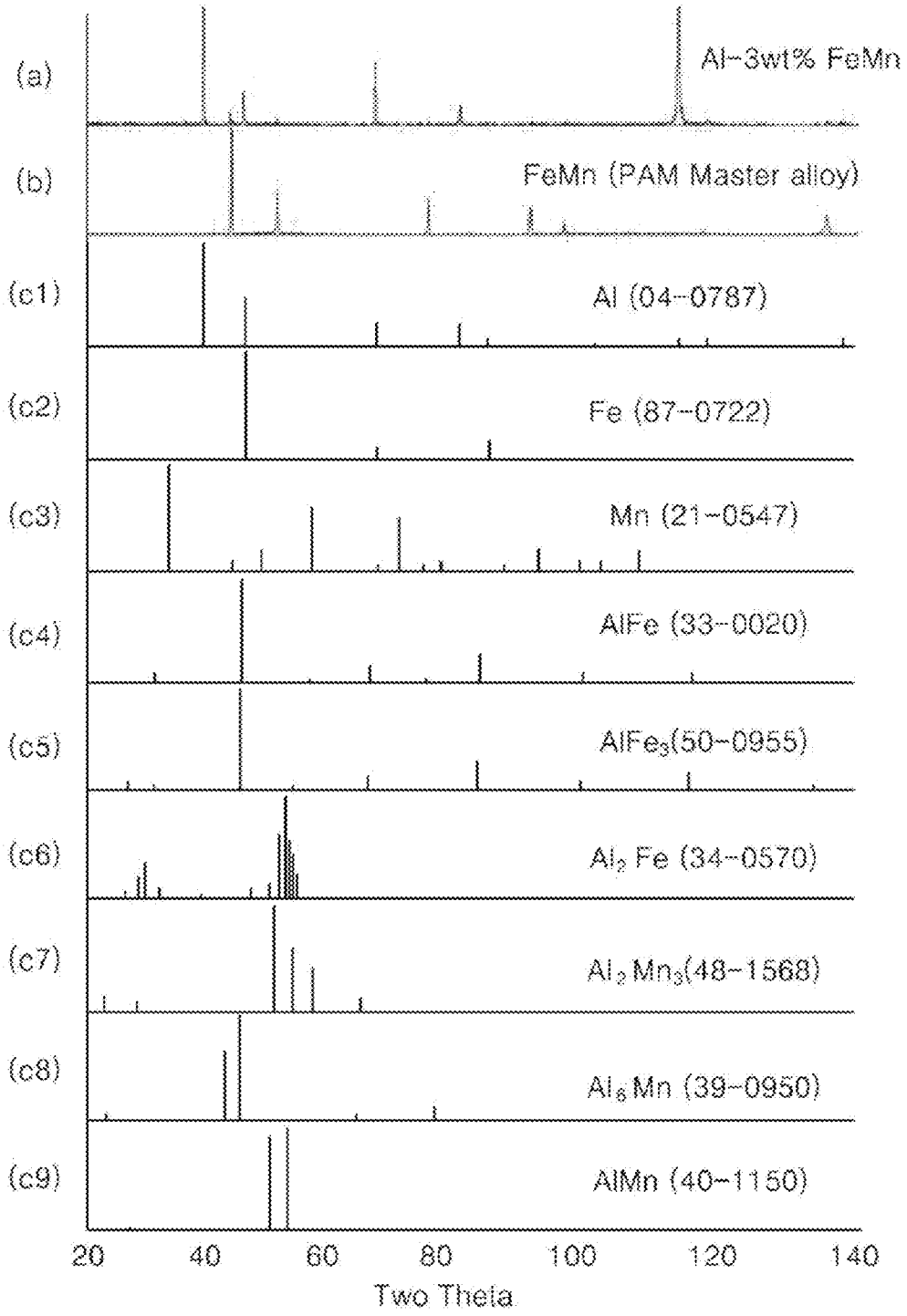
FIG. 10 compares X-ray diffraction (XRD) peaks of an aluminum alloy according to an experimental example of the present invention with XRD peak data from standard cards.

FIG. 10 illustrates results of X-ray diffraction (XRD) analysis of the sample prepared in Experimental Example 1. In FIG. 10, (a) represents peaks of Experimental Example 1, (b) represents peaks of an iron-manganese master alloy, and (c1) to (c9) respectively represent aluminum (Al), iron (Fe), manganese (Mn), AlFe, $AlFe_3$, $Al_2Fe$, $Al_2Mn_3$, $Al_6Mn$, and AlMn peak data from standard cards.

Referring to the results of XRD analysis of FIG. 10, it may be understood that most of the peaks (see (a)) of the sample of Experimental Example 1 corresponded to aluminum peaks (see (c1)) from the standard card and other peaks corresponded to iron-manganese complete solid solution peaks (see (b)) of the master alloy. That is, it may be understood that the peaks excluding the aluminum peaks in the sample of Experimental Example 1 did not overlap iron peaks (see (c2)) or peaks of aluminum-iron compounds (see (c4) to (c6)) and manganese peaks (see (c3)) or peaks of aluminum-manganese compounds (see (c7) to (c9)), but overlapped the main peaks (see (b)) of the iron-manganese complete solid solution. Therefore, it may be confirmed again that the iron-manganese complete solid solution was formed in the aluminum alloy.

Figure 6:
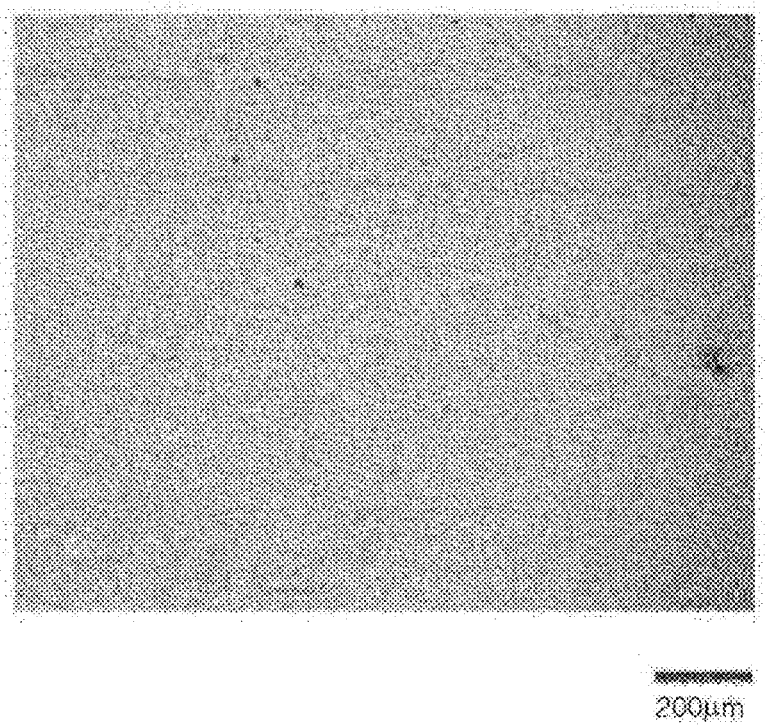
FIG. 6, after the sample according to Experimental Example 1 is heat treated at 300° C. for 200 hours, is an image obtained by optical microscope observation of a microstructure of the heat-treated sample.

FIG. 6, after the sample according to Experimental Example 1 is heat treated at 300° C. for 200 hours, is an image obtained by optical microscope observation of a microstructure of the heat-treated sample Referring to FIG. 6, it may be understood that the strengthening phase formed of the iron-manganese complete solid solution, different from a typical intermetallic compound that may be coarsened or phase-decomposed in the aluminum matrix at a high temperature, maintained the same shape of a facet as the microstructure illustrated in FIG. 4. Thus, it may be understood that the aluminum alloy according to the present invention had relatively stable heat resistance properties even at 300° C. by including the iron-manganese complete solid solution strengthening phase.

Therefore, it may be understood that the strengthening phase formed of the above-described iron-manganese complete solid solution strengthened heat resistance properties of the aluminum alloy and the aluminum alloy having the strengthened phase formed therein exhibited excellent properties as a heat-resistant alloy.

Figure 7:
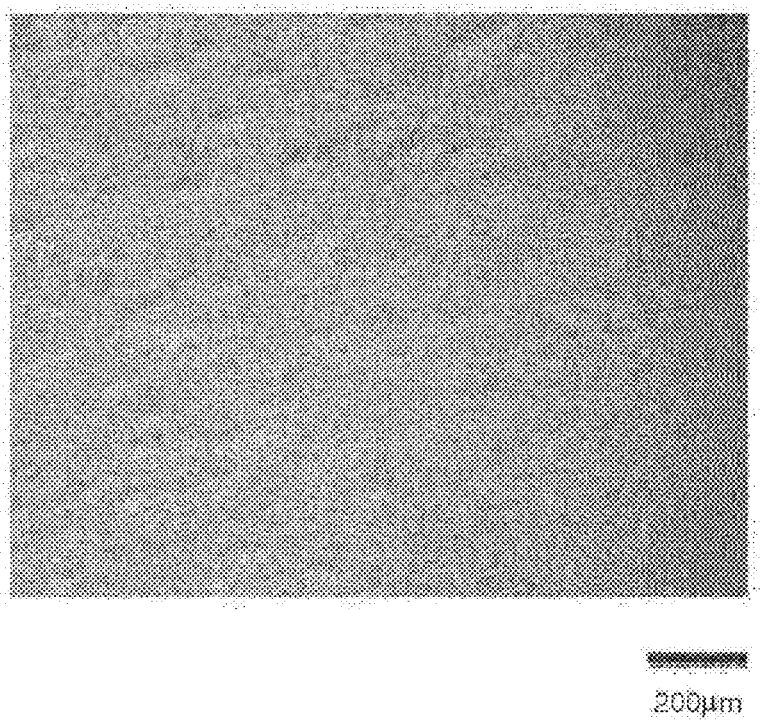
FIG. 7 is an image obtained by optical microscope observation of a microstructure of a sample which is prepared by remelting the sample according to Experimental Example 1 and then casting.

FIG. 7 is an image obtained by optical microscope observation of a microstructure of a sample which was manufactured by remelting the sample prepared in Experimental Example 1 and then casting. Herein, the cast sample after the remelting was prepared by casting after the sample prepared in Experimental Example 1 was remelted at the melting point of aluminum.

Referring to FIG. 7, it may be confirmed that the iron-manganese complete solid solution in the aluminum alloy according to Experimental Example 1 was not coarsened or decomposed at all even during the remelting, but almost maintained the shape before the remelting. Therefore, it is expected that the aluminum alloy according to the present invention may not only have excellent heat resistance properties by including the iron-manganese completed solid solution strengthening phase, but may also be used in actively recycling aluminum, i.e., a matrix metal, and Fe and Mn, i.e., alloying elements, in the level of eco-friendly raw materials during the recycling of the aluminum alloy.

EXPERIMENTAL EXAMPLE 2

Similar to Experimental Example 1, an aluminum melt was formed by melting aluminum at 700° C. in an induction melting furnace. Then, an iron-manganese master alloy, which was manufactured to have compositions of iron and manganese respectively to be 50 wt % using a plasma arc melting method, was added to the melt so as to obtain compositions of iron-manganese complete solid solutions in aluminum alloys to be 0.5 wt %, 1 wt %, 3 wt %, 5 wt %, 7 wt %, 9 wt %, 10 wt %, and 11 wt % while the temperature was maintained at 700° C. The temperature was held for about 30 minutes to about 60 minutes to completely melt the added iron and manganese, and samples of aluminum alloys were prepared by casting the melts.

Figure 8:
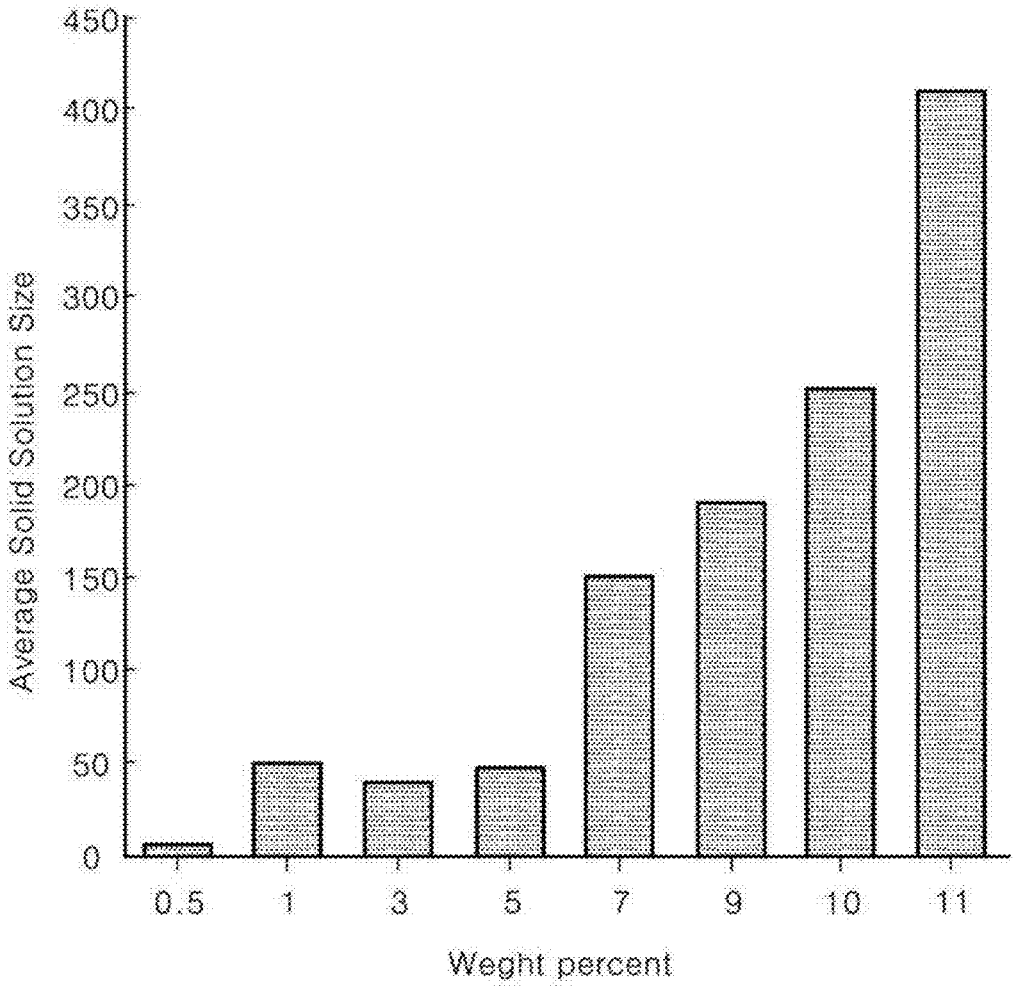
FIG. 8 is a graph illustrating average sizes of completed solid solutions of samples according to Experimental Example 2 according to an amount of alloying elements.

FIG. 8 is a graph illustrating average sizes of completed solid solutions of the samples according to Experimental Example 2 according to an amount of alloying elements.

Referring to FIG. 8, in a case where 0.5 wt % of the iron-manganese alloy was added, it may be understood that the amount of the complete solid solution was relatively low and the size thereof was small at 10 μm or less. In contrast, in a case where 10 wt % or more of the iron-manganese alloy was added, it may be understood that the size of the complete solid solution was coarsened to about 250 μm or more. In a case where 1 wt % to 9 wt % of the iron-manganese alloy was added, the size of the complete solid solution may be maintained at 200 μm or less.

As a result, the amount of the iron-manganese alloy may be selected within a range of less than 10 wt % in consideration of the size of the complete solid solution or within a range of greater than 0.5 wt % in consideration of the amount of the complete solid solution. However, in a case where the amount of the complete solid solution may be relatively low for the improvement of casting quality, the amount of the iron-manganese alloy may be maintained within 0.5 wt %. In addition, in a case where the aluminum alloy was not significantly dependent on the size of the complete solid solution, the amount of the iron-manganese alloy may be selected to be 10 wt % or more. Herein, the amount of the iron-manganese alloy may substantially denote the amount of the iron-manganese complete solid solution. In the embodiments of the present invention, the amount of the iron-manganese complete solid solution may be controlled to be the same as the amount of the iron-manganese alloy in consideration of the size thereof.

EXPERIMENTAL EXAMPLE 3

The aluminum alloy of Experimental Example 1 was used as the first aluminum alloy, and samples of the second aluminum alloy were prepared by diluting the first aluminum alloy by being added to an aluminum melt that was melted using an electric furnace. A composition of an iron-manganese complete solid solution of the prepared second aluminum alloy was 0.8 wt %.

Figure 9:
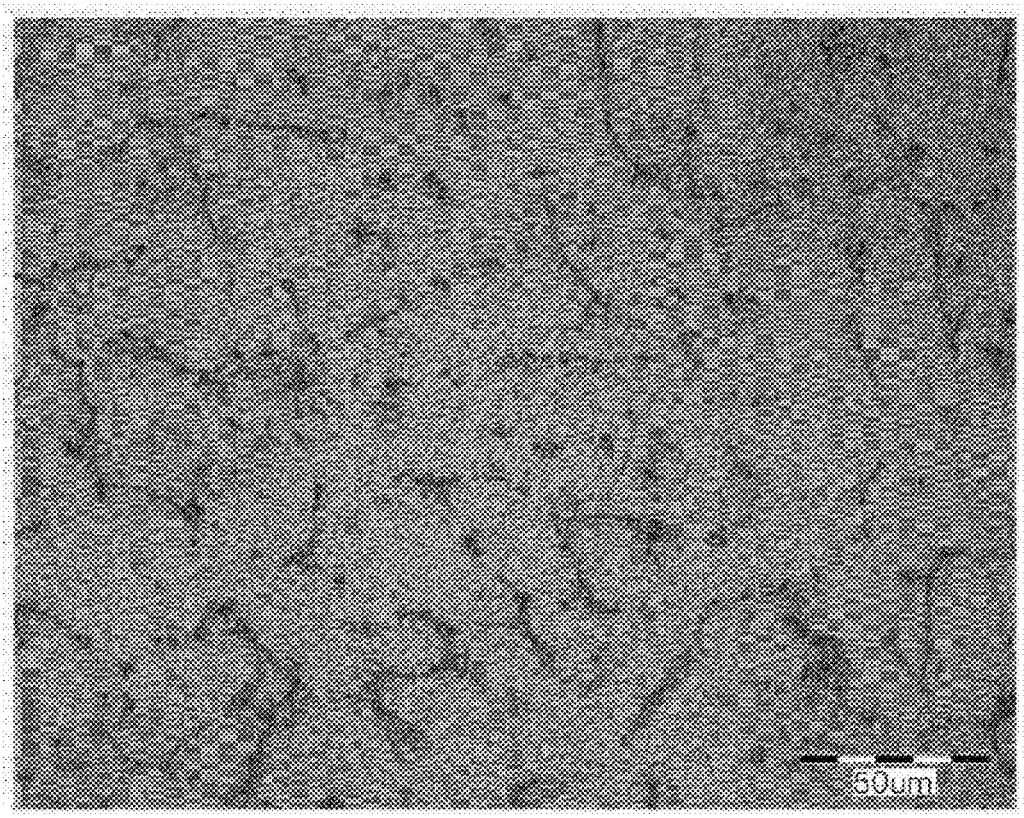
FIG. 9 is an image obtained by optical microscope observation of a microstructure of an aluminum alloy according to Experimental Example 3.

FIG. 9 is an image obtained by optical microscope observation of the aluminum alloy according to Experimental Example 3. Referring to FIG. 9, it may be understood that the aluminum alloy after the dilution had a micro-sized iron-manganese complete solid solution that was dispersed in the aluminum matrix. It may be understood that the size of the complete solid solution in the aluminum alloy after the dilution was significantly decreased in comparison to the size (see FIG. 4) of the complete solid solution in the aluminum alloy before the dilution.

EXPERIMENTAL EXAMPLE 4

Table 1 represents a composition (all units are in wt %) of an aluminum alloy according to Experimental Example 4 and Table 2 represents a composition (all units are in wt %) of an aluminum alloy according to Comparative Example 1. As illustrated in Tables 1 and 2, the aluminum alloy of Experimental Example 4 corresponded to an aluminum alloy in which iron and manganese in the aluminum alloy (referred to as so-called "ALDC 12 Al alloy") of Comparative Example 1 were replaced with an iron-manganese alloy. The above alloys were cast using a die in the state of a melt and typically denoted as die casting alloys.

Iron-manganese alloy powder prepared in advance using an atomization method was prepared, and the aluminum alloy according to Experimental Example 4 was then manufactured by adding the iron-manganese powder to an aluminum melt, in which other alloying elements were melted, and die casting the melt. The aluminum alloy according to Comparative Example 1 was manufactured by melting corresponding alloying elements in an aluminum melt and then casting the melt. The melts during the casting of the aluminum alloys according to Experimental Example 4 and Comparative Example 1 were manufactured using a typical electric melting method.

TABLE 1

| | Alloy | | | | | | | |
|---|---|---|---|---|---|---|---|---|
| | Cu | Si | Mg | Zn | FeMn | Ni | Sn | Al |
| Experimental Example 4 | 1.5-3.5 | 9.6-12.0 | 0.3< | 1.0< | 0.8 | 0.5< | 0.2< | bal. |

TABLE 2

| | Alloy | | | | | | | | |
|---|---|---|---|---|---|---|---|---|---|
| | Cu | Si | Mg | Zn | Fe | Mn | Ni | Sn | Al |
| Comparative Example 1 | 1.5-3.5 | 9.6-12.0 | 0.3< | 1.0< | 1.3< | 0.5< | 0.5< | 0.2< | bal. |

Figure 11A:
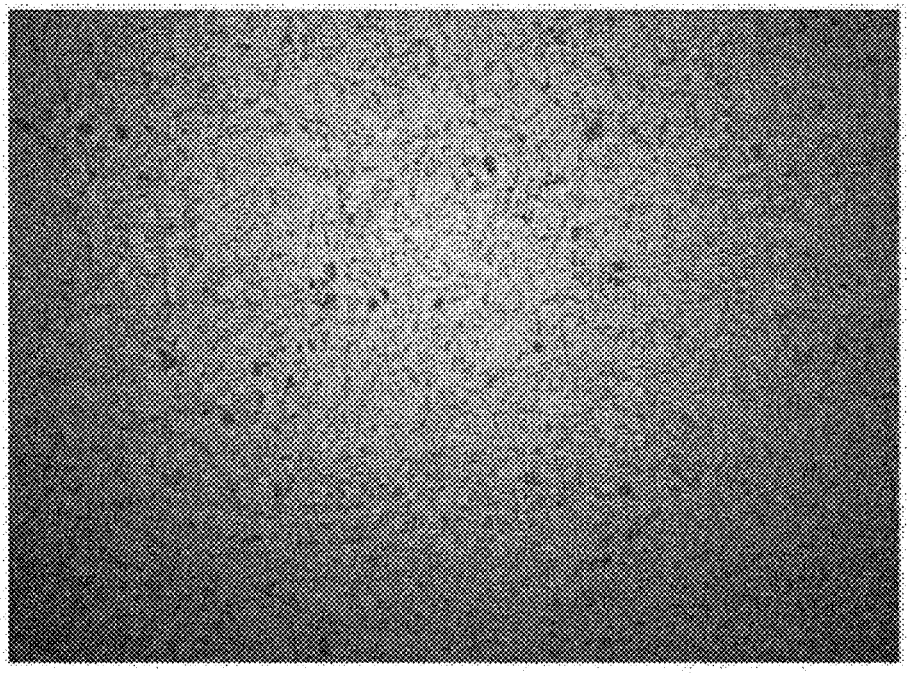
FIG. 11A is an image of a microstructure of an aluminum alloy according to Experimental Example 4.
Figure 11B:
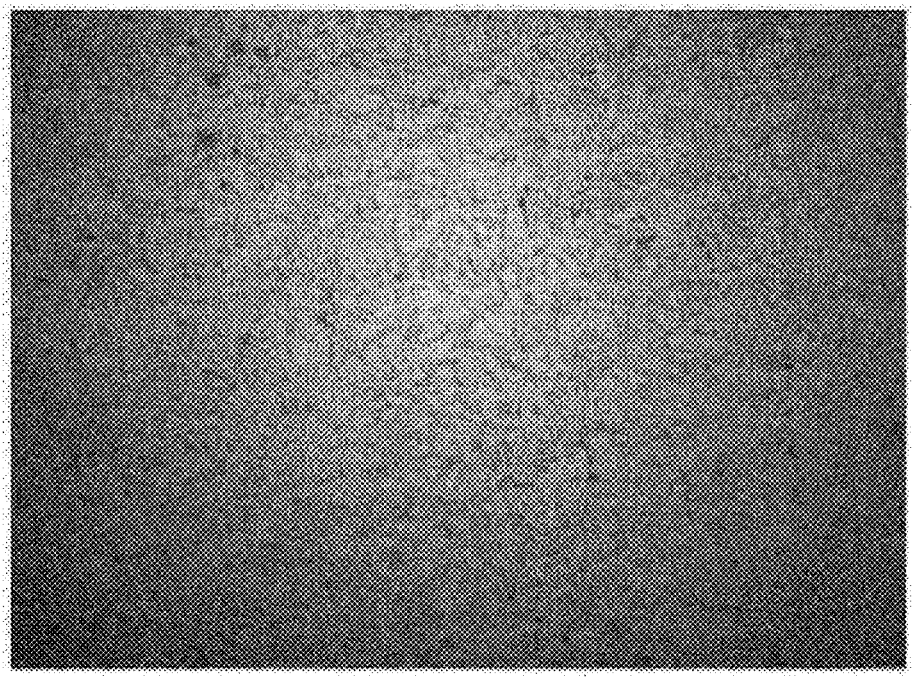
FIG. 11B is an image of a microstructure of an aluminum alloy according to Comparative Example 1.

FIG. 11A is an image of a microstructure of the aluminum alloy according to Experimental Example 4, and FIG. 11B is an image of a microstructure of the aluminum alloy according to Comparative Example 1. Referring to FIGS. 11A and 11B, it seemed that there was no significant difference between the microstructures of the two alloys. It was considered that this may be due to the low amount of the iron-manganese alloy included. With respect to Experimental Example 4, the iron-manganese complete solid solution was distributed in the aluminum matrix. However, with respect to Comparative Example 1, it was considered that since the iron-manganese complete solid solution may not be formed by the typical electric melting method, a compound between aluminum and iron or a compound between aluminum and manganese may be distributed in the aluminum matrix.

Table 3 represents mechanical properties of the aluminum alloy according to Experimental Example 4 and the aluminum alloy according to Comparative Example 1.

TABLE 3

| Alloy | Yield strength (MPa) | Tensile strength (MPa) | Elongation (%) |
|---|---|---|---|
| Experimental Example 4 | 148 | 241 | 3.2 |
| Comparative Example 1 | 154 | 228 | 1.2 |

Referring to Table 3, the difference between the strengths of Comparative Example 1 and Experimental Example 4 was not significant. However, it may be understood that the difference between the elongations was considerably large. In relation to the foregoing, with respect to Comparative Example 1, a predetermined amount of iron was added to prevent the soldering with a die, and in addition, manganese was simultaneously added. However, since the adverse effect of iron was not sufficiently inhibited, the elongation of the aluminum alloy was low at about 1.2%. In contrast, with respect to Experimental Example 4, since iron and manganese were added as the iron-manganese alloy, the iron and manganese existed as the iron-manganese complete solid solution in the aluminum alloy. Thus, it may be understood that the quality of the alloy was improved by effectively inhibiting the adverse effect of iron. With respect to Experimental Example 4, in terms of the fact that a melt treatment was not performed, it may be expected that better mechanical properties may be secured when bubble defects were controlled by the melt treatment, such as bubbling and/or high pressure and high vacuum.

EXPERIMENTAL EXAMPLE 5

Table 4 represents a composition (unit for beryllium (Be) is in ppm and the other units are in wt %) of an aluminum alloy according to Experimental Example 5, and Table 5 represents a composition (unit for Be is in ppm and the other units are in wt %) of an aluminum alloy according to Comparative Example 2. As illustrated in Tables 4 and 5, the aluminum alloy of Experimental Example 5 corresponded to an aluminum alloy in which iron and manganese in the aluminum alloy of Comparative Example 2 were replaced with an iron-manganese alloy. The alloys according to Experimental Example 5 and Comparative Example 2 were manufactured in a similar manner as the alloys of Experimental Example 4.

TABLE 4

| | Alloy | | | | | | | |
|---|---|---|---|---|---|---|---|---|
| | Cu | Si | Mg | Zn | FeMn | Ti | Be | Al |
| Experimental Example 5 | 0.05 | 1.8-2.6 | 5.0-6.0 | 0.07< | 0.8 | 0.2< | 40 ppm< | bal. |

TABLE 5

| | Alloy | | | | | | | | |
|---|---|---|---|---|---|---|---|---|---|
| | Cu | Si | Mg | Zn | Fe | Mn | Ti | Be | Al |
| Comparative Example 2 | 0.05 | 1.8-2.6 | 5.0-6.0 | 0.07< | 0.2< | 0.5-0.8 | 0.2< | 40 ppm< | bal. |

Figure 12A:
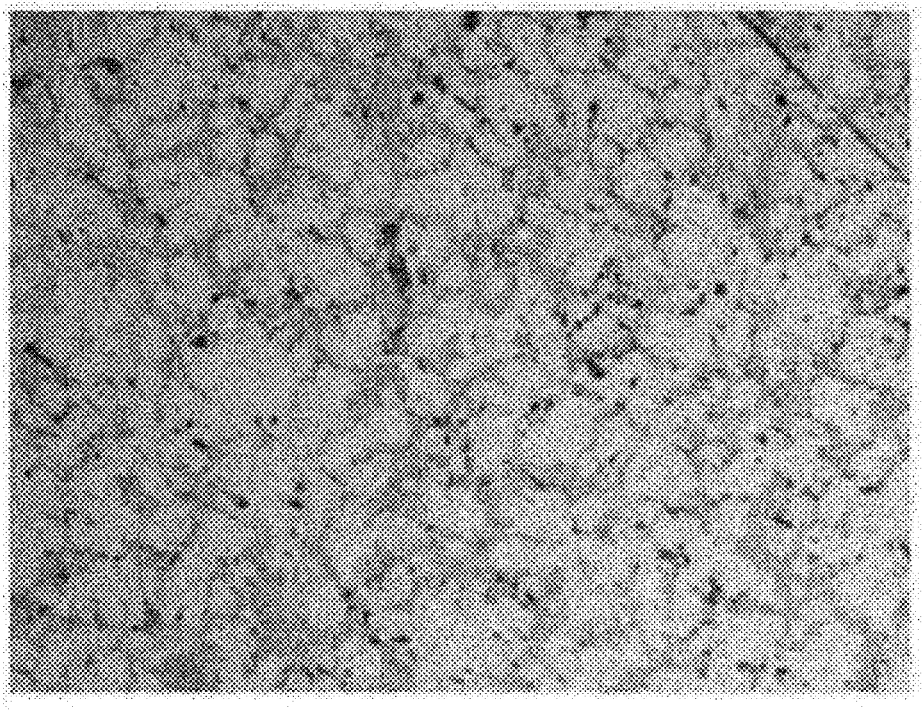
FIG. 12A is an image of a microstructure of an aluminum alloy according to Experimental Example 5.
Figure 12B:
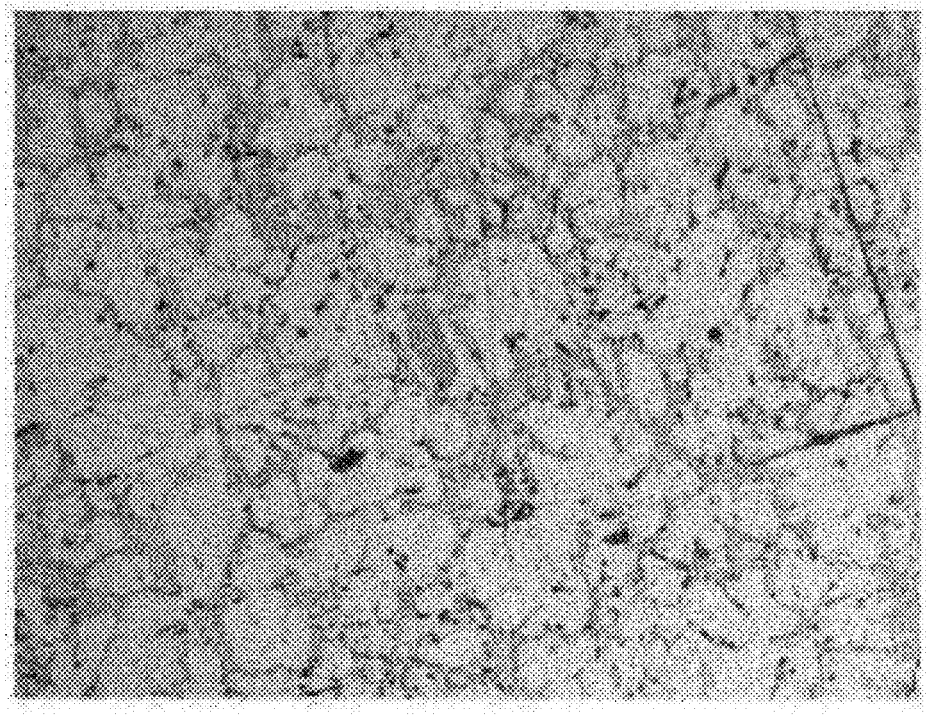
FIG. 12B is an image of a microstructure of an aluminum alloy according to Comparative Example 2.

FIG. 12A is an image of a microstructure of the aluminum alloy according to Experimental Example 5, and FIG. 12B is an image of a microstructure of the aluminum alloy according to Comparative Example 2. Referring to FIGS. 12*a* and 12B, it seemed that there was no significant difference between the microstructures of the two alloys. It was considered that this may be due to the relatively low amount of the iron-manganese alloy included. With respect to Experimental Example 5, the iron-manganese complete solid solution was distributed in the aluminum matrix. However, with respect to Comparative Example 2, it was considered that since the iron-manganese complete solid solution may not be formed by the typical electric melting method, a compound between aluminum and iron or a compound between aluminum and manganese may be distributed in the aluminum matrix.

Table 6 represents mechanical properties of the aluminum alloy according to Experimental Example 5 and the aluminum alloy according to Comparative Example 2.

TABLE 6

| Alloy | Yield strength (MPa) | Tensile strength (MPa) | Elongation (%) |
|---|---|---|---|
| Experimental Example 5 | 150 | 245 | 6.1 |
| Comparative Example 2 | 151 | 243 | 6.2 |

Referring to Table 6, with respect to Experimental Example 5 and Comparative Example 2, it may be understood that both alloys exhibited almost similar properties in terms of strength and elongation. These alloys exhibited very high elongation as well as high mechanical strength. Comparative Example 2 exhibited an elongation that is 5 times or more higher than that of Comparative Example 1. One of the reasons for having the higher elongation in the case of the aluminum alloy of Comparative Example 2 was considered that the amount of iron was very low. However, in this case, die soldering characteristics may be problematic.

Figure 13:
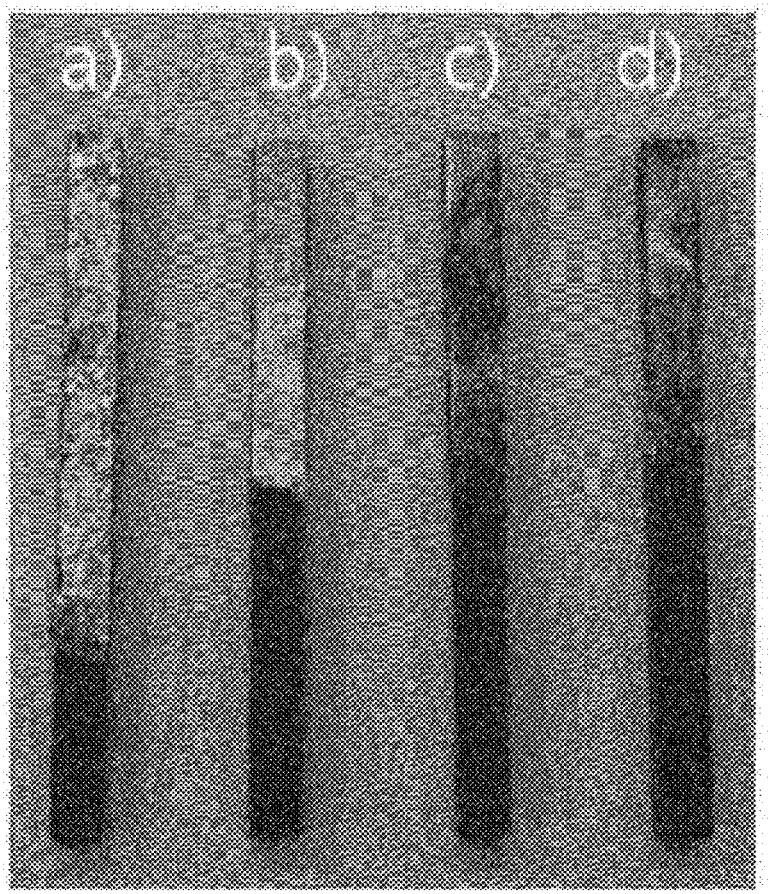
FIG. 13 is images illustrating immersion characteristics of a die material in melts of the aluminum alloys according to comparative examples and experimental examples.

FIG. 13 is results of observation of the surfaces of die material samples after the samples were immersed in melts of the aluminum alloys according to Comparative Example 1, Experimental Example 4, Comparative Example 2, and Experimental Example 5. STD 61 samples were used as the die material samples. The above samples were immersed and maintained for 120 minutes in the melts of the aluminum alloys according to Comparative Example 1, Experimental Example 4, Comparative Example 2, and Experimental Example 5, and then taken out from the melts to be analyzed.

Table 7 represents changes in thickness before and after the immersion of the die material in each melt.

TABLE 7

| Melt | Original material thickness (mm) | Thickness after immersion (mm) | Erosion thickness (μm) |
|---|---|---|---|
| Comparative Example 1 (a) | 10.37 | 10.03 | 340 |
| Experimental Example 4 (b) | 10.26 | 9.89 | 370 |
| Comparative Example 2 (c) | 10.42 | 9.73 | 690 |
| Experimental Example 5 (d) | 10.31 | 10.11 | 200 |

Referring to FIG. 7, with respect to the samples ((a) and (b)) that were immersed in Comparative Example 1 and Experimental Example 4, their erosion thicknesses were similar. In contrast, with respect to the samples ((c) and (d)) that were immersed in Comparative Example 2 and Experimental Example 5, it may be understood that the difference between their erosion thicknesses was about 3.4 times or more. Therefore, with respect to Comparative Example 1 and Experimental Example 4 in which iron were included to some extent, there was no significant difference between die soldering characteristics. However, it may be understood that, with respect to Experimental Example 5 in which the iron-manganese alloy was added instead of iron, the die soldering may be significantly decreased in comparison to Comparative Example 2 in which iron was almost not included.

When the results were summarized, it may be understood that similar die soldering characteristics were basically observed in the case of adding an iron component in the form of an element to the aluminum alloy or in the case of adding an iron component in the form of an iron-manganese alloy to the aluminum alloy. However, in the case that iron in the form of an element was added to the aluminum melt, the adverse effect of iron was not sufficiently inhibited. In contrast, it may be understood that when manganese was alloyed with iron and added to the aluminum melt in the form of an iron-manganese alloy, the adverse effect of iron may be sufficiently inhibited to obtain excellent elongation properties.

Therefore, in die casting aluminum alloys, it may be understood that two effects, such as the prevention of die soldering and the inhibition of the adverse effect of iron, which may not be typically obtained simultaneously, may be obtained by adding iron to the aluminum melt in the form of an iron-manganese alloy instead of in the form of an element.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A method of manufacturing an aluminum alloy, the method comprising:

providing iron-manganese alloy powder having an iron-manganese complete solid solution;

introducing the iron-manganese alloy powder into an aluminum melt without melting the iron-manganese alloy powder; and die casting the aluminum melt to manufacture an aluminum alloy with the iron-manganese complete solid solution distributed in an aluminum matrix, wherein the iron-manganese alloy powder is prepared using an atomization method to form the iron-manganese complete solid solution.

2. The method of claim 1, wherein the iron-manganese alloy powder is added to the aluminum melt in an amount greater than 0 wt % and equal to or less than 2 wt %.

3. The method of claim 2, wherein the aluminum melt comprises copper and silicon as additive elements in addition to aluminum as a parent material.

4. The method of claim 3, wherein, in the aluminum melt, an amount of the copper is in a range of 1 wt % to 4 wt % and an amount of the silicon is in a range of 9 wt % to 13 wt %.

5. The method of claim 2, wherein the aluminum melt comprises silicon and magnesium as additive elements in addition to aluminum as a parent material.

6. The method of claim 5, wherein, in the aluminum melt, an amount of the silicon is in a range of 1 wt % to 3 wt % and an amount of the magnesium is in a range of 4 wt % to 7 wt %.

7. A method of manufacturing an aluminum alloy, the method comprising:

providing a first aluminum alloy including a first amount of an iron-manganese complete solid solution;

melting the first aluminum alloy in an aluminum melt; and casting the aluminum melt to manufacture a second aluminum alloy including a second amount, which is smaller than the first amount, of the iron-manganese complete solid solution, wherein the providing a first aluminum alloy comprises, providing iron-manganese alloy powder having the first amount of the iron-manganese complete solid solution, the iron-manganese alloy powder being prepared using an atomization method to form the iron-manganese complete solid solution;

introducing iron-manganese alloy powder into an first aluminum melt without melting the iron-manganese alloy powder; and die casting the first aluminum melt to manufacture the first aluminum alloy with the iron-manganese complete solid solution distributed in an aluminum matrix.

8. The method of claim 7, wherein the second amount is greater than 0.5 wt % and less than 10 wt %.

9. The method of claim 7, wherein an average size of the second amount of the iron-manganese complete solid solution is smaller than an average size of the first amount of the iron-manganese complete solid solution.

* * * * *